United States Patent [19]

Drews et al.

[11] Patent Number: 5,042,471

[45] Date of Patent: Aug. 27, 1991

[54] RESPIRATOR WITH SEVERAL REGENERATION CARTRIDGES AND BREATHER BAGS

[75] Inventors: Wolfgang Drews, Zarpen; Ernst-Günther Kolbe, Mölln; Hasso Weinmann, Lübeck, all of Fed. Rep. of Germany

[73] Assignee: Drägerwerk Aktiengesellschaft, Lübeck, Fed. Rep. of Germany

[21] Appl. No.: 443,713

[22] Filed: Nov. 29, 1989

[30] Foreign Application Priority Data

Dec. 2, 1988 [DE] Fed. Rep. of Germany ..... 3840606

[51] Int. Cl.[5] ..... A62B 7/08

[52] U.S. Cl. ..... 128/202.26; 128/205.13

[58] Field of Search ..... 128/202.26, 205.13

[56] References Cited

U.S. PATENT DOCUMENTS 4,157,091 6/1979 Pampuch ..... 128/202.26

4,200,092 4/1980 Warncke et al. ..... 128/202.26

4,515,156 5/1985 Khudosovtsev et al. ..... 128/202.26

4,665,910 5/1987 Kolbe et al. ..... 128/202.26

*Primary Examiner*—Edgar S. Burr

*Assistant Examiner*—Stephen R. Funk

*Attorney, Agent, or Firm*—McGlew & Tuttle

[57] ABSTRACT

A respirator with regeneration of the respired air by several chemical fillings, which emit oxygen and bind carbon dioxide and are disposed in parallel in the respiratory passage between a mouthpiece and a breather bag is to be improved, so that a uniform utilization of the chemicals in the fillings is achieved. The different resistances of the respiratory paths of the fillings are to be evened up so that the pollutant load on and the consumption of the fillings can be divided up evenly over the existing fillings during the whole of the period of use. For this purpose, provisions are made so that each filling is connected to its own breather bag for accommodating the exhaled air flowing through it.

8 Claims, 2 Drawing Sheets

RESPIRATOR WITH SEVERAL REGENERATION CARTRIDGES AND BREATHER BAGS

FIELD OF THE INVENTION

The invention relates in general to respiration and in particular to a new and useful respirator device and method with regeneration of the respired air by means of several chemical fillings, which emit oxygen and bind carbon dioxide and are disposed in parallel in the respiratory passage between a mouthpiece and a breather bag.

BACKGROUND OF THE INVENTION

A similar respirator is disclosed in the German Offenlegungsschrift 3,324,222. The known respirator operates by recycling. The arrangement provides a chemical cartridge lying in the respiratory passage. Such a respirator has two chemical fillings, which are disposed in parallel and, starting out from the mouthpiece, are supplied with the exhaled air of the wearer of the respirator. The exhaled air passes through a connecting pipe and reaches a manifold chamber, from which it is distributed into the two chemical fillings. In the chemical fillings, the exhaled air is freed from carbon dioxide and water and enriched with oxygen. After passing through the chemical fillings, the enriched, respired air is combined in a common exhaled air bag. From there, it reaches the mouthpiece directly when the wearer of the respirator breathes in. The cyclic respiration is assured by the appropriate insertion of check valves in the respirator tubes, so that the chemical fillings are always supplied during an exhalation and the prepared amount of respiratory air is taken directly from the breather bag during an inhalation.

Admittedly, the parallel arrangement of several chemical fillings enables the period of use of such a respirator to be extended. This is due to the fact the amount of chemicals regenerating the respired air is increased and yet the resistance to breathing remains low. However, it is not possible to guarantee that the chemical fillings, which are connected in parallel, are supplied uniformly with air during their period of use. Due to the different resistances to flow that result from different flow conditions of the breath in the individual beds or also due to the different lengths of the paths of flow of the respired gas through the differently supported beds, one of the fillings is supplied preferentially with air. The filling supplied with air is the one which offers the least resistance to the flow of the respired gas. As a result, however, the bed in question is also consumed more rapidly than the other and is blanketed by the consumed chemicals. Then, however, one less chemical filling less is available for the further respiration, the breathing resistance increases and the advantage of the parallel supply of air to several chemical fillings is given up prematurely.

SUMMARY OF THE INVENTION

The present invention provides a respirator arrangement which ensures a uniform utilization of the chemicals in the filling and different respiration path resistances of the fillings are evened so that any pollutant is loaded on the fillings and the fillings are consumed equally during the whole period of their use.

In accordance with the invention a breather bag is connected to each of several fillings to accommodate the exhaled air flowing through. By means of the invention, it is achieved that each chemical filling is supplied with air with its own breather bag, so that different respiration flow relationships or respiratory path resistances no longer have an effect o the premature exhaustion of a single or several chemical beds. If namely one of the chemical beds were to be supplied with air preferentially because of its lesser respiratory path resistance, the breather bag connected to this bed would also be filled more quickly than the breather bag at the other bed, which is supplied with less air, so that, due to the pressure developing in the first breather bag after it is filled, the respiratory path resistance is increased and the subsequent respired air necessarily must flow through the second chemical bed, which initially is supplied with less air. The breather bags thus have a regulatory effect on the loading of the different chemical fillings.

By these means, existing chemical beds are charged uniformly during the period of use and the respiratory path flow is always distributed among all the existing chemical beds. Accordingly, the user of the device can utilize the advantage of a lower respiratory flow resistance through the chemical cartridges.

Advantageously, each chemical filling is accommodated in its own cartridge. As a result, it is easy to select a structural shape, which permits a modular construction of the cartridges, which then, in case of need, can be exchanged for new ones after they have been used up. Moreover, the same modular component can be used to construct devices with different outputs. This makes it easier to keep stocks on hand.

Each breather bag can be equipped with a pressure safety valve for setting the maximum air supply pressure permitted for the particular breather bag.

Advisably, the exhalation takes place over an exhalation tube with an exhalation valve and the inhalation takes place over an inhalation tube with an inhalation valve. The valves ar disposed at the ends of the tubes facing the cartridges. By these means, reciprocating respiration in the respirator tubes is avoided and the dead space is reduced.

It has proven to be advantageous to dispose the starter for the chemical cartridges in a distribution chamber that communicates with the cartridges. From the distribution chamber, the oxygen, which is formed to bridge the starting phase, is directly available to the wearer of the device and the excess is distributed uniformly over the parallel cartridges as basic filling in the breather bags.

The invention with its advantageous embodiments can be used in the reciprocating mode as well as in the cyclic mode. When used in the reciprocating mode, an additionally more uniform loading of the chemical cartridges is achieved since the cartridges are charged with exhaled air and during an inhalation phase, the exhaled air in the breather bag flows through them. Thus the exhaled air in the breather bag, which may not have been regenerated completely, is regenerated further during the repeated passage through the chemical cartridge. An appreciably better utilization of the chemical beds is thus obtained.

If the respirator is used in the cyclic mode, it is advantageous to pass the expired air in the breather bags over tubing connected with these bags to the mouthpiece. This tubing contains a pressure-loaded valve, which opens during the inhalation phase. During the exhalation phase, the breather bags are filled up to a pressure permitted by the pressure-loaded valves. Only due to the reduced pressure existing downstream from the valve during the inhalation phase does this valve open up and permit the exhaled air in the breather bag to flow to the mouthpiece.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
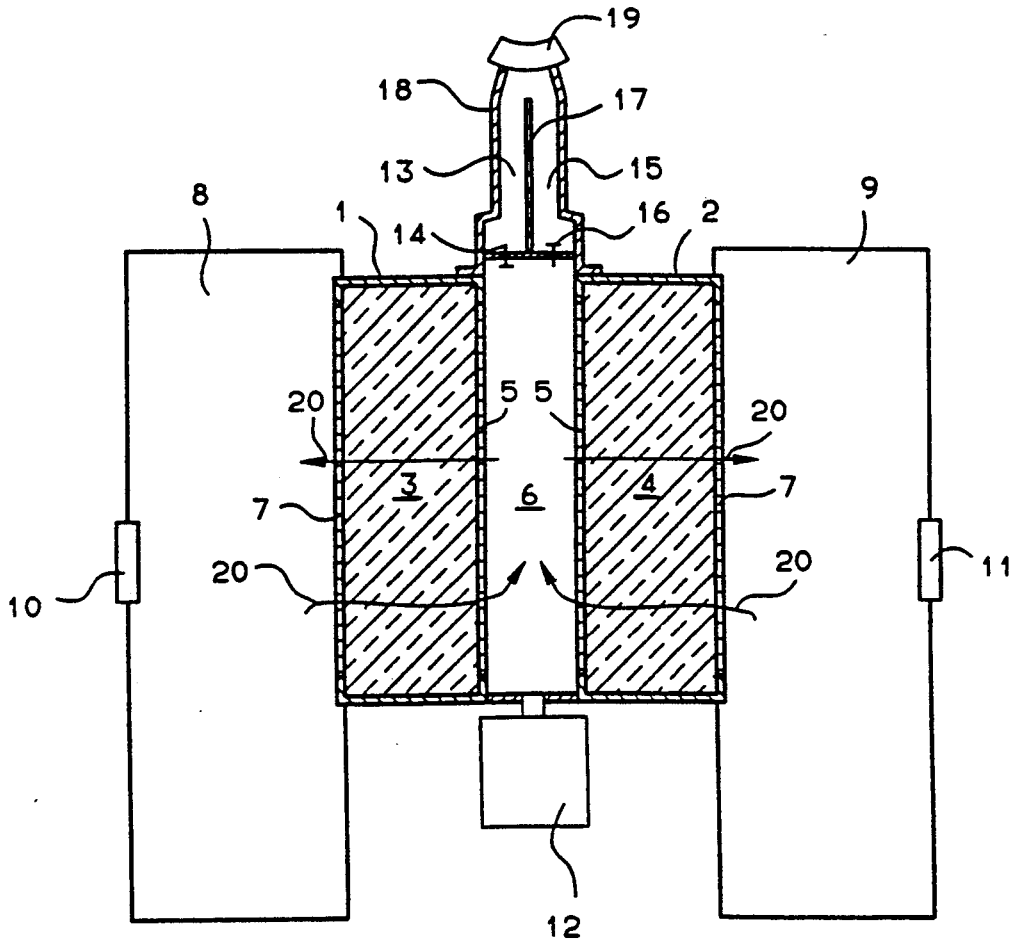
FIG. 1 is a schematic sectional view of a respirator for a reciprocating mode of respiration constructed in accordance with the invention.

The respirator shown in FIG. 1 has two regenerators or two chemical cartridges 1 and 2 with a chemical filling 3 and 4 which includes material that binds carbon dioxide and water and gives off oxygen. One opening 5 of the cartridges is connected to a distribution chamber 6 and another opening 7 is connected to its own breather bag 8 and 9 respectively. The cartridge openings 5 and 7 are formed by an air-permeable screen grid, which holds the chemical fillings 3 and 4 in place. Each of the breather bags 8 and 9 is equipped with a respective pressure safety valve 10 and 11.

A starter or oxygen generator 12 is connected to the distribution chamber 6. The starter 12 is filled with an oxygen-generating material, such as sodium chlorate which, when use of the respirator commences, is ionized, for example by the addition of a previously specified amount of water. Furthermore, an exhalation tube 13 with an exhalation valve 14, as well as an inhalation tube 15 with an associated inhalation valve 16 open out into the distribution chamber 6. The two tubes 13 and 15 are combined in a common breather tube 18, which is divided by a partition 17 and ends in a mouthpiece 19.

The direction of flow of the inhaled and exhaled air is indicated by the directional arrows 20 shown.

Figure 2:
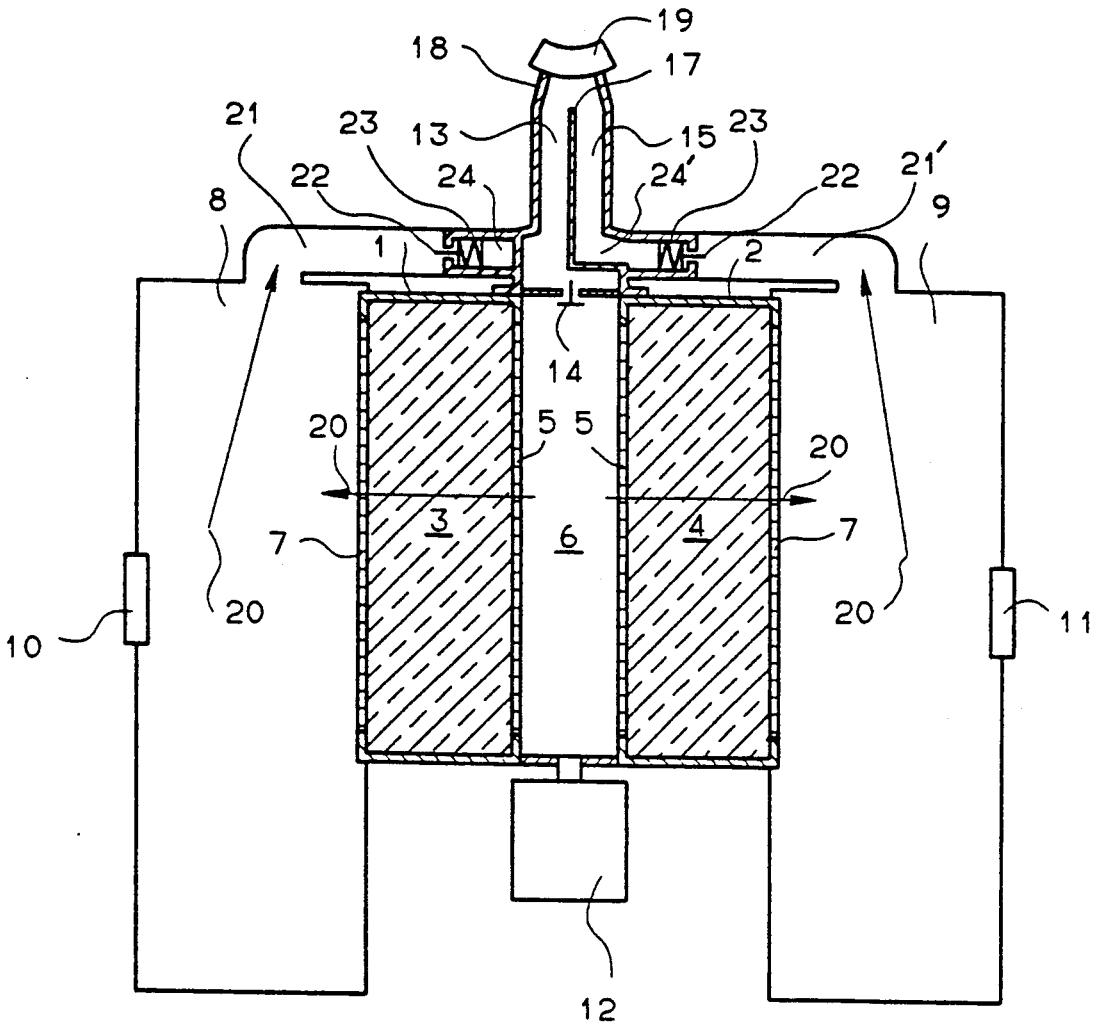
FIG. 2 is a view similar to FIG. 1 of a respirator for a cyclic mode.

The respirator shown in FIG. 2 is suitable for a cyclic mode. Components, which are the same as those shown in FIG. 1, have been given the same reference numbers. To make possible the cyclic mode of this embodiment, tubing 21 and 21' leads from the breather bags 8 and 9 to the surrounding chamber 24 and 24' formed by chamber walls 23 and including valves 22.

While a specific embodiment of the invention has been shown and described in detail to illustrate the application of the principles of the invention, it will be understood that the invention may be embodied otherwise without departing from such principles.

What is claimed is:

1. A respirator, comprising: means defining a respiratory passage having a mouthpiece; a plurality of regenerators connected to said respiratory passage for the regeneration of respired air, each regenerator having a separate chemical filling, said filling being formed of a material which emits oxygen and binds carbon dioxide; and, a plurality of breather bags, one of said breather bags being connected to each regenerator for accommodating exhaled air flowing through it.

2. A respirator, comprising a first cartridge and a second cartridge, each cartridge having a filler material therein for generating oxygen, a breathing tube having an inhalation and respiration passage connected to each of said first and second cartridges, and a first breather bag and a second breather bag said first breather bag being connected to said first cartridge and said second breather bag being connected to said second cartridge.

3. A respirator according to claim 2, wherein each of said first breather bag and said second breather bag has a pressure safety valve.

4. A respirator according to claim 2, wherein said breathing tube includes an inhalation tube portion and an exhalation tube portion and an inhalation valve in said inhalation tube, and an exhalation valve in said exhalation tube said inhalation and exhalation valves being set to permit passage of the breathing air in a direction comparable to the respiratory breathing direction.

5. A respirator according to claim 2, further comprising a starter and means defining a distributor chamber between said first and second cartridges connected to said starter.

6. A respirator according to claim 2, wherein said respirator is operable in a reciprocating mode.

7. A respirator according to claim 2, wherein said respirator is operated in a cyclic mode and wherein exhalation air in one of said first breathing bag and said second breathing bag can be passed, during an inhalation phase to a mouthpiece by means of said inhalation tube and an inhalation valve which is loaded to open in an inhalation air direction.

8. A method of operating a respirator comprising the steps of: directing exhalation air through a respiratory passage through a plurality of exhalation chamber cartridges having means for enriching the air with oxygen and providing a passage to a breathing bag from one of said plurality of exhalation chamber cartridges and providing another passage to another breathing bag from another of said plurality of exhalation chamber cartridges to maintain an even distribution of flow through each cartridge.

* * * * *